US009050632B2

(12) United States Patent
Frederick et al.

(10) Patent No.: US 9,050,632 B2
(45) Date of Patent: Jun. 9, 2015

(54) CLEANING DEVICE FOR PAINTBALL EQUIPMENT

(75) Inventors: Benjamin Lynn Frederick, Gotha, FL (US); Edward Evans, Woodville (CA)

(73) Assignee: HTR Development, LLC, Gotha, FL (US)

( * ) Notice: Subject to any disclaimer, the term of this patent is extended or adjusted under 35 U.S.C. 154(b) by 593 days.

(21) Appl. No.: 13/281,746

(22) Filed: Oct. 26, 2011

(65) Prior Publication Data

US 2012/0102667 A1 May 3, 2012

Related U.S. Application Data

(60) Provisional application No. 61/387,611, filed on Oct. 27, 2010.

(51) Int. Cl.

| | |
|---|---|
| ***F41A 29/02*** | (2006.01) |
| ***B08B 9/00*** | (2006.01) |
| ***F41A 15/22*** | (2006.01) |

(52) U.S. Cl.

CPC . *B08B 9/00* (2013.01); *F41A 15/22* (2013.01); *F41A 29/02* (2013.01)

(58) Field of Classification Search

CPC ..... F41A 29/02; F41A 29/00; B08B 9/00; B08B 9/02; B08B 9/027; A46B 2200/3013

USPC ..... 15/104.16, 104.165, 104.05; 42/95; 403/305, 307, 361

See application file for complete search history.

(56) References Cited

U.S. PATENT DOCUMENTS

| | | | | |
|---|---|---|---|---|
| 1,665,257 | A * | 4/1928 | Dake | 15/104.165 |
| 3,064,294 | A | 11/1962 | Stocking | |
| 4,698,932 | A | 10/1987 | Schneider | |
| 4,866,871 | A * | 9/1989 | Rivers | 42/95 |
| 4,930,240 | A * | 6/1990 | Bice | 42/95 |
| 5,038,509 | A * | 8/1991 | Stephan | 42/95 |
| 5,447,572 | A * | 9/1995 | LaClair | 134/8 |
| D393,115 | S | 3/1998 | Bell | |
| 5,972,125 | A | 10/1999 | Hedge | |
| 5,987,799 | A | 11/1999 | Dedeaux et al. | |
| 6,088,866 | A | 7/2000 | Hedge | |
| 6,701,658 | B1 | 3/2004 | Brownell | |
| 7,055,279 | B2 | 6/2006 | Flores | |
| D525,402 | S | 7/2006 | Dochterman | |
| 7,367,151 | B1 | 5/2008 | Black et al. | |
| 7,377,003 | B1 | 5/2008 | Dochterman et al. | |
| 7,395,763 | B1 | 7/2008 | Vari | |
| 8,176,592 | B1 | 5/2012 | Carpenter et al. | |
| 8,661,724 | B2 * | 3/2014 | Crawford | 42/95 |
| 2009/0283115 | A1 * | 11/2009 | Dentico | 134/22.1 |
| 2011/0099880 | A1 | 5/2011 | Stephens et al. | |

* cited by examiner

*Primary Examiner* — Laura C Guidotti

(74) *Attorney, Agent, or Firm* — Woodard, Emhardt, Moriarty, McNett & Henry LLP

(57) ABSTRACT

Among other things, there is disclosed a cylindrical device which is used to remove broken paintballs and other unwanted material from the barrel of a paintball marker or from other paintball equipment. Cylindrical cleaning devices currently known in the art are prone to separation and failure after use. The present disclosure utilizes a series of barbs and/or openings such as through holes to prevent such failure. Structure for cleaning, including squeegee elements and other materials and configurations, are also disclosed.

32 Claims, 13 Drawing Sheets

CLEANING DEVICE FOR PAINTBALL EQUIPMENT

The present application claims the benefit of U.S. Provisional Application No. 61/387,611, which has a filing date of Oct. 27, 2010, and the entirety of which is incorporated by reference herein.

This disclosure generally relates to a device (referred to generally herein as a "swab") which is used to clean paintball equipment, particularly the bore of a paintball gun or paintball storage devices (also known as "pods").

BACKGROUND

The sport of paintball generally involves individuals or teams armed with pneumatic launchers ("guns" or "markers") that shoot pellets filled with paint or dye ("paintballs"). A variety of different formats of play exist and the rules of play are usually a function of the particular format, but the objective usually involves the firing of paintballs at other individuals, teams or targets. The score of each game is usually a function of how many opposing individual(s) or target (s) a team or individual can hit with one or more paintballs, or of how many paintballs a team or individual can successfully impact with the predefined opponent(s) or target(s).

Because paintballs are fragile and intended to break upon impacting a target, they can inadvertently break in the paintball marker, paintball loader, or in the barrel of the paintball marker. This premature breakage can be caused by a number of events or conditions, including a paintball that is too large or small for a marker barrel or other equipment, a paintball that is improperly seated in the marker chamber upon firing, climate conditions, or manufacturing defects in the paintball or equipment. This premature breakage of a paintball is often referred to as "chopping," a "chopped ball," or a "barrel break." When a paintball is chopped, a quantity of paint or dye that was contained within the paintball coats internal areas of the paintball marker, usually including but not necessarily limited to the marker's barrel. This unwanted coating of paint or dye interferes with the finely-tuned ballistics or other firing or performance characteristics of the paintball marker and can result in inaccurate shots or even total equipment failure.

Over the past number of years, many paintball devices have been invented which reduce the number of chopped balls. The most effective invention has been a set of break-beam sensors which are located in the breech of the paintball marker and automatically abort the firing sequence of the paintball marker should the sensor detect an improperly chambered paintball. Although improvements such as this have reduced the frequency of chopped balls, the problem has yet to be eliminated.

Once a paintball is chopped or otherwise fails within the marker or barrel, it is imperative that the user clean the equipment to prevent further breakage or equipment failure. The player can use a squeegee to remove the paint or dye from the barrel. Swabs are similarly available for the cleaning of a barrel (e.g. FIGS. 1-2). Available swabs consists of two rods R connected with a flexible connector C. Such swabs have a plurality of rods so the player may fold the swab to place it on his person; the folding of a swab reduces the overall length of the swab and increases player comfort when running, jumping, or sliding with the swab in a pocket, for example. The distal ends of the rods are covered in an absorbent substance A. When a chopped ball occurs, the player unfolds his swab, sticks it into the barrel, and subsequently removes the swab. Because of physical contact between the paintball barrel and the swab, a quantity of unwanted paint or dye is absorbed or otherwise pulled out or ejected from the barrel. Although a significant amount of paint or dye is removed by this process, a quantity usually still remains which can interfere with the firing, ballistics or other performance characteristic of the paintballs and/or the marker. Further, the connection between the two rods of a swab frequently fails and allows the two rods to separate, thus rendering the swab less useful or unusable.

A larger version of these swabs is often used to clean out paintball pods that have been contaminated by a paintball that has broken. These larger swabs are practically identical in form and function to the swabs discussed above, but the larger swabs are used to mitigate paintball breakage in other paintball equipment and not breakage in the paintball marker.

However, problems with existing swabs are common. Among such problems associated with existing implements are fatigue on a connecting piece after folding several times. The fatigue can result in weakness, separation or breakage of the connecting piece. Existing products tend to be susceptible to kinking when being inserted into a device to be cleaned. Further, the product can come apart, e.g. by the connecting piece failing or a rod portion pulling out of the connecting piece, when the product is pulled to remove it from the paintball device.

SUMMARY

Among other things, there is disclosed a cleaning device for paintball equipment which may be cylindrical, and that includes at least two rods, each rod with a proximal end with at least one barb or protrusion, and/or with at least one through hole. Such devices can also include at least one squeegee flange operatively connected to the rods, and/or one or more respective absorbent materials or pieces surrounding a distal end of each respective rod. Multiple such pieces on a rod may be placed in a tapered or alternating pattern.

In examples disclosed herein, devices for cleaning paintball equipment include a first rod having a distal portion or end and a proximal portion or end, with the proximal portion or end of the first rod having at least one barb or protrusion, and/or at least one opening directed outward from a central longitudinal axis of the first rod. A second rod having a distal portion or end and a proximal portion or end, with the proximal portion or end of the second rod having at least one barb or protrusion, and/or at least one opening directed outward from a central longitudinal axis of the second rod. A connector is attached fixed to each of the proximal portions or ends, with the connector in contact with each of the noted features on the proximal portions (e.g. barb(s) or opening(s)). The contact includes contact with at least a portion of a barb if a feature on a rod is a barb, and includes entering an opening if a feature on a rod is an opening. Thus, a rod may have one or more such barbs or protrusions, one or more such openings, or one or more of each. A first absorbent piece is fixed to the distal portion or end of the first rod, and a second absorbent piece is fixed to the distal portion or end of the second rod.

In particular embodiments, such a connector is a monolithic piece, and/or may be molded around the rods so that the connector surrounds the barb(s) on the rods. The connector can be of a natural or synthetic rubber material having flexibility sufficient to allow folding of the device at a part of the connector, while having sufficient sturdiness to hold the rods in a substantially linear position during cleaning use. For instance, the connector may be flexible so that in a first unfolded condition said connector holds the rods so that they are at least approximately linear with each other, and in a second folded condition the connector bends and holds the rods so that they are at least approximately parallel to and laterally adjacent to each other. The respective openings of the respective rods may be linear through holes, having first and second apertures diametrically opposed on the respective rods. In such cases, the connector may extend through both those first and second apertures of the through hole(s), and in particular examples forms a monolithic column within the through hole(s). In other instances, one or both of the respective openings are grooves, and the connector may be a sleeve and/or include a boss entering such groove(s) to hold the rod(s) and connector together. Particular embodiments include one or both rods having a proximal portion or end with a tapering surface that extends to a rounded proximal end. As explained further below, at least two barbs and two holes may be provided for each of the rods.

Embodiments are shown with at least one squeegee flange at a medial portion of the connector, and such a flange may have a diameter approximately the same as the inner diameter of a marker barrel. The flange(s) may be of the same material as the connector and/or be monolithic with the connector.

In other embodiments, a paintball equipment cleaning device is disclosed that includes a first rod with a central longitudinal axis, a first proximal portion and a first distal portion. The first proximal portion includes a first plurality of barbs and a first plurality of holes, with each of the first plurality of barbs having a proximally-facing surface that is substantially perpendicular to the rod's central longitudinal axis and a generally distally-facing surface that is angled with respect to the rod's central longitudinal axis, and each of the first plurality of holes being linear and extending through a full diameter of the rod. A similar or identical second rod has a central longitudinal axis, a second proximal portion and a second distal portion. That second proximal portion includes a second plurality of barbs and a second plurality of holes, with each of the second plurality of barbs having a proximally-facing surface that is substantially perpendicular to its rod's central longitudinal axis and a generally distally-facing surface that is angled with respect to its rod's central longitudinal axis, and each of the second plurality of holes being linear and extending through a full diameter of the second rod. A flexible connector is attached to the respective proximal portions of the rods to connect the rods together. The connector contacts at least the proximally-facing surfaces of each of said first and second pluralities of barbs, and it has respective portions extending through each of the first and second pluralities of holes. The connector further has a medial portion with at least one full-circumferential flange.

Examples of such embodiments include a first absorbent piece attached to the distal portion of the first rod, and/or a second absorbent piece attached to the distal portion of the second rod. The connector may be a monolithic piece of a single material, such as a natural or synthetic rubber or polyurethane material. The respective portions of the connector that extend through the holes may be columns that extend entirely through the holes and join portions of the connector on diametrically-opposed portions of the respective rods. One or both rods may have a tapered portion of their respective proximal portions. In particular examples, the connector is molded (e.g. injection molded) onto the rods, or may be a sleeve having a bosses that fit into holes or openings on the rods. Such a sleeve may not necessarily contact at least part of any tapered portion of the rod(s).

Methods for making and using the embodiments noted above are also discussed. For example, devices as discussed herein may be made using a method including molding a material around proximal portions or ends of rods so that the material contacts barbs or protrusions on the rods and enters openings in the rods to form a flexible connector that connects the rods together.

Also disclosed are embodiments of a squeegee member usable with swabs or other rod-type cleaning tools. An example of such a squeegee member includes a base, a middle portion having a fold, and a tip portion, and can be fitted onto a rod. The tip portion is held stationary with respect to a rod, and the base is slidable with respect to the tip portion and the rod. When the base slides toward the tip portion, the middle portion is compressed so that the fold moves away from the rod (e.g. radially away from the rod), and when the base slides away from the tip portion, the middle portion is extended so that the fold moves toward the rod (e.g. radially toward the rod). The rod may include a notch, with the base sliding within that notch. Such structure can be used with a single such rod, or with swabs that include multiple rods, e.g. at the and of one or both such rods of a swab.

In particular embodiments, the squeegee member base includes a plurality of radial fins configured (e.g. sized or formed) to engage an inner diameter of a structure to be cleaned, with the fins separated by at least one space. For example, material to be cleaned by the squeegee member or a device it is attached to or a part of can pass by the fins through the space(s). A base configured to engage an inner diameter of a structure to be cleaned, during insertion of the squeegee member into such structure, can be at least partially held by the inner diameter of the structure to move the base away from the tip portion to create a space between the fold and the inner diameter of the structure. Additionally or alternatively, embodiments of a base configured to engage an inner diameter of a structure to be cleaned, during pulling out of the squeegee member from the structure to be cleaned, can be at least partially held by the inner diameter of the structure to move the base toward the tip portion to force the fold against the inner diameter of the structure. The base may have at least one support adjacent a surface of said rod, which may define an open space or pocket between a portion of the squeegee member and the rod surface, to prevent or limit binding of the squeegee member to the rod during use, or preventing the entirety of the base from compressing against the rod surface during use. Particular embodiments of squeegee members are adapted for insertion into and withdrawal from a structure having an internal surface to be cleaned. During insertion a fold of the squeegee member is extended so as not to contact the internal surface, and during withdrawal that fold is compressed so as to be pressed against the internal surface. Changes to or from the fold's extended state or condition, or to or from the compressed state or condition, automatically occurs by changing insertion or withdrawal characteristics. That is, in some embodiments the only action needed to change the squeegee member from an extended state or condition (i.e. during insertion) to a compressed state or condition (i.e. during extraction or withdrawal) is a change in the force the user applies (e.g. from pushing for insertion to pulling for withdrawal, with perhaps a no-force stationary condition in between).

Embodiments of a flexible squeegee member that can be used for cleaning the inside of paintball equipment is disclosed, as for example by attachment to a rod or other elongated support. The squeegee member expands and contracts in diameter when a user respectively pushes it into and pulls it out of the equipment or structure to be cleaned.

The present disclosure describes among other things an improved swab which utilizes a barb system and through hole design to prevent separation and further adds a squeegee on the connector to aid in paint or dye removal.

DETAILED DESCRIPTION OF THE ILLUSTRATED EMBODIMENTS

Figure 1:
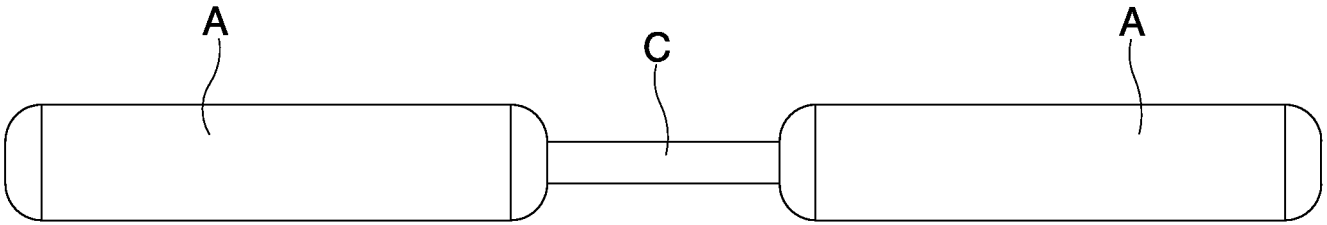
FIG. 1 (prior art)
FIG. 1 illustrates a swab currently known in the art.
Figure 2:
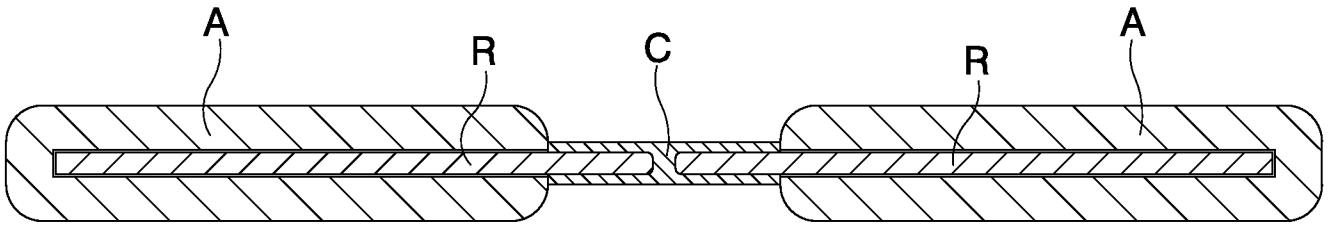
FIG. 2 (prior art)
FIG. 2 is a cutaway or cross-sectional view of the swab of FIG. 1

For the purposes of promoting an understanding of the principles of the disclosure, reference will now be made to the embodiments illustrated in the drawings and specific language will be used to describe the same. It will nevertheless be understood that no limitation of the scope of the claims is thereby intended, and alterations and modifications in the illustrated devices and methods, and further applications of the principles of the disclosure as illustrated therein are herein contemplated as would normally occur to one skilled in the art to which the disclosure relates.

Referring generally to the drawings, there is shown an embodiment of a swab device 20 for use in cleaning or clearing a barrel or other portions of a paintball marker (not shown). As explained further below, the illustrated embodiment of swab 20 includes two separate rods or elongated members 23 which are joined by a connector 28. Absorbent pieces 31 are attached to or covering a portion of respective rods 23. In the illustrated embodiment, swab 20 has a generally cylindrical form at either end and in the middle, for ease in insertion, rotation and withdrawal from a marker barrel or other portion or device to be cleaned. It will be understood that other shapes or configurations of swab 20, such as rectangular, octagonal or oval, can also be used.

The illustrated embodiment of rods 23 are substantially identical to each other. Each such rod 23 is substantially cylindrical and elongated. A distal portion or end 41 has a substantially smooth exterior in this embodiment, and a proximal end 42 joins to connector 28. As used above, "distal" indicates a portion directed generally away from connector 28 (e.g. the middle of swab 20), and "proximal" indicates a portion directed generally toward or in contact with connector 28. The diameter of rod 23 is substantially uniform, culminating in a rounded end portion 43 in this embodiment, and rod 23 has a length substantially greater than its diameter. Rods 23 are sturdy structures, being rigid or having limited flexibility in order to support absorbent pieces 31 during use. Accordingly, strong materials such as metals, wood, sturdy synthetic materials (e.g. hard plastics), or combinations can be used for rods 23. Fiberglass has been used in embodiments of rods 23, and has been found to have an advantage insofar as wool pieces can be effectively glued to it for the purpose of making a swab.

Figure 5:
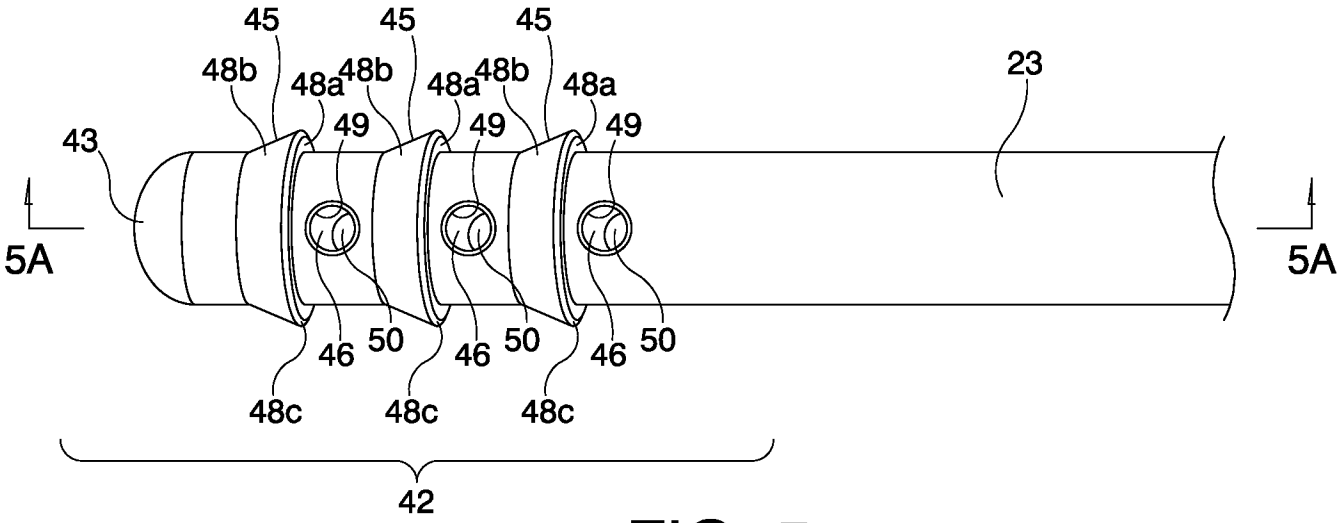
FIG. 5 is a perspective view of the proximal end of an embodiment of a rod usable in the embodiments of FIG. 3 or 4, including barbs and mold through-holes.

As already noted, distal portion or end 41 of a rod 23 is substantially smooth in the illustrated embodiment, for ease of insertion and connection to a respective piece 31. Proximal portion or end 42 includes a number of barbs or protrusions 45 and through-holes 46 in this embodiment. In embodiments in which rod 23 has a generally uniform outer diameter, barbs 45 extend outward from that outer diameter. The exemplary barbs 45 in FIG. 5 extend all the way around the circumference of rod 23. It will be understood that in other embodiments barbs 45 may extend only part of the way around the circumference, have breaks or gaps in them as they extend around part or all of that circumference, and/or are staggered around the circumference. Again referring to the example of FIG. 5, barbs 45 include a generally distally-facing surface 48*a* that is substantially perpendicular to the longitudinal axis of rod 23, and a generally proximally-facing surface 48*b* that is substantially conical around that longitudinal axis. A bevel or slanted surface 48*c* may be found between surfaces 48*a* and 48*b* in certain embodiments. The illustrated embodiment of rod 23 includes three such circumferential barbs 45, each of which is separated from its adjacent barb(s) 45 by a distance. While three such barbs 45 have been determined to be effective, it will be understood that the number of barbs may be one or more.

Holes 46 are provided in rods 23 for interaction with connector 28, as will be described further below. In the particular illustrated embodiment, holes 46 are generally cylindrical and extend linearly through rod 23 with an opening 49 in one side of rod 23 and a diametrically opposed opening 50. In that embodiment, a central longitudinal axis of a hole 46 intersects the central longitudinal axis of rod 23. Holes 46 are adjacent to barbs 45. In the illustrated embodiment, three holes 46 are provided, with two being between respective pairs of barbs 45 and one hole 46 being distal of the distal-most barb 45. It will be understood that one or more holes 46 may be provided in other embodiments. Holes 46 that extend all the way through rod 23, i.e. that have two apertures such as apertures 49 and 50, are believed to be preferable as will be explained further below.

Connector 28 joins the proximal portions or ends 42 of respective rods 23 to form a unit. Connector 28 is preferably flexible, elastic and grippable, forming a covering or sleeve around each of rods 23. In particular embodiments, connector 28 is a rubber (natural or synthetic), plastic or similar material molded around proximal parts 42 of rods 23. As seen in the drawings (e.g. FIG. 6), the illustrated embodiment of connector 28 surrounds a portion of each rod 23 and has a solid medial portion 51 between the respective distal ends of rods 23 and along their respective longitudinal axes. That is, a space or region between rods 23 is filled with connector material. Having such material within medial portion 51 provides support to connector 28 and between rods 23 that reduces the likelihood of kinking at medial portion 51 and the fatigue that goes along with it. It also provides a more direct transmission of force in a longitudinal direction from one rod 23 to the other, so that pushing swab 20 into a paintball device using the non-inserted rod 23 more easily inserts the swab and does not tend to force side portions of connector 28 outward. The material of connector 28 extends into and through holes 46, forming in particular embodiments columns of connector material monolithic with the rest of connector 28 through the body of rods 23 (e.g. FIG. 4A), or in other embodiments extending at least part way into holes 46. Particular embodiments of connector 28 have an uneven or ribbed exterior (e.g. FIGS. 4, 4A) to enhance grip and/or stability of connector 28. As examples, cylindrical ribs 51*a* or helically-winding ribs can extend around connector 28.

Figure 3:
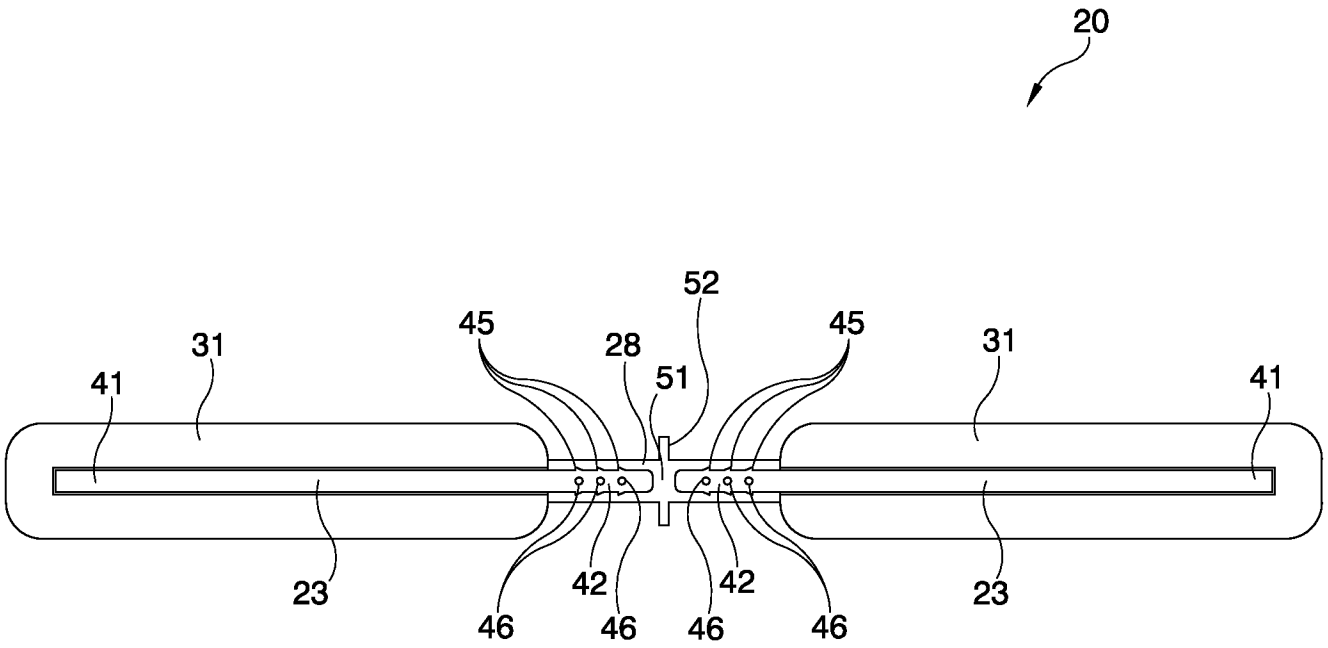
FIG. 3 is a cutaway or cross-sectional view of an embodiment of the present disclosure, including the presence of a squeegee flange.
Figure 6:
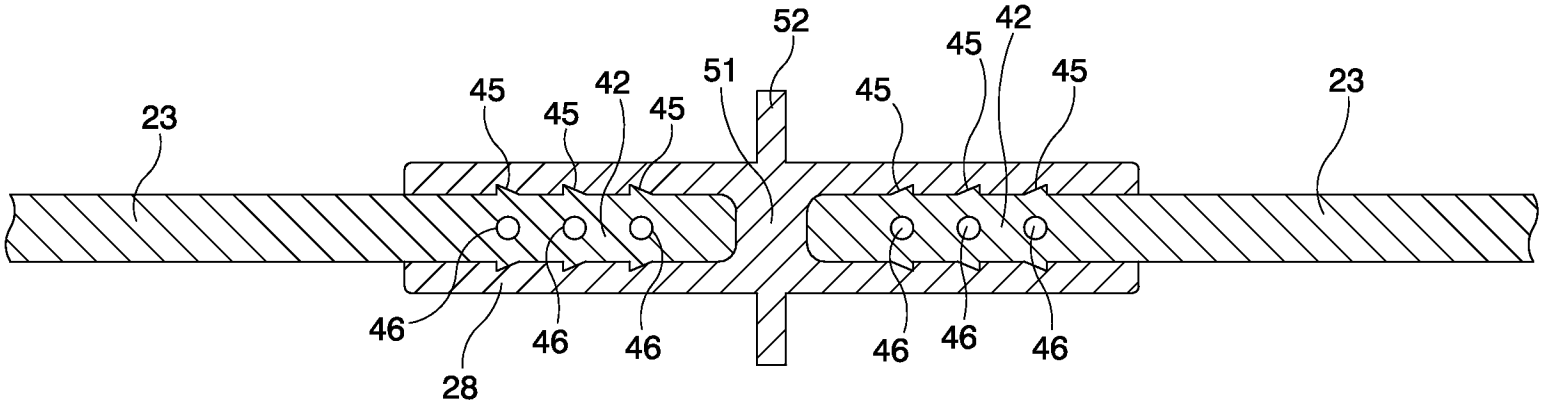
FIG. 6 is a cutaway or cross-sectional view of embodiments of a connection mechanism, proximal ends of rods, and squeegee flange of the embodiment of FIG. 3.
Figure 7:
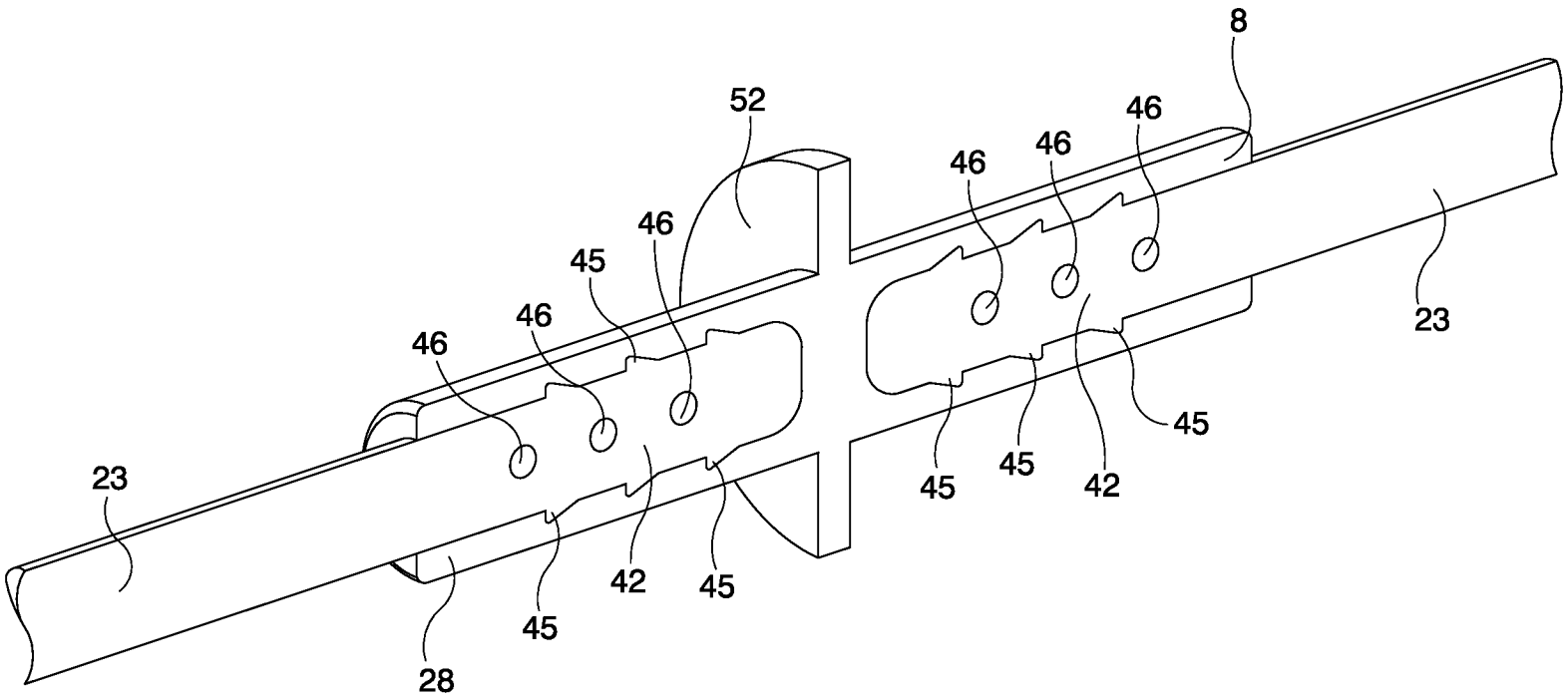
FIG. 7 is a perspective view of the embodiments shown in FIG. 6.

As seen in FIGS. 3, 6 and 7, embodiments of connector 28 may include a squeegee flange 52. Flange 52 may be formed with connector 28 (e.g. both connector 28 and squeegee flange 52 are created from or by the same mold) to be monolithic with or inseparable from the rest of connector 28, or they may be separately made and attached to connector 28. Flexible, rubber or rubber-like materials as indicated above with respect to connector 28 can be used for squeegee flange 52, and if flange 52 is made in the same molding process with the rest of connector 28, it will be understood that one material can be used. The illustrated embodiments show flange 52 as a thin disc or disc-like structure that is substantially perpendicular to the longitudinal axes of one or both of rods 23 in a normal or unfolded state (e.g. when device 20 is to be used for cleaning), and is positioned at or around medial portion 51 of connector 28, e.g. in a position between and/or not overlapping either rod 23. Connector 28 may contain any number of squeegee flanges 52 to aid in the removal of debris from the paintball marker or other equipment.

Figure 4:
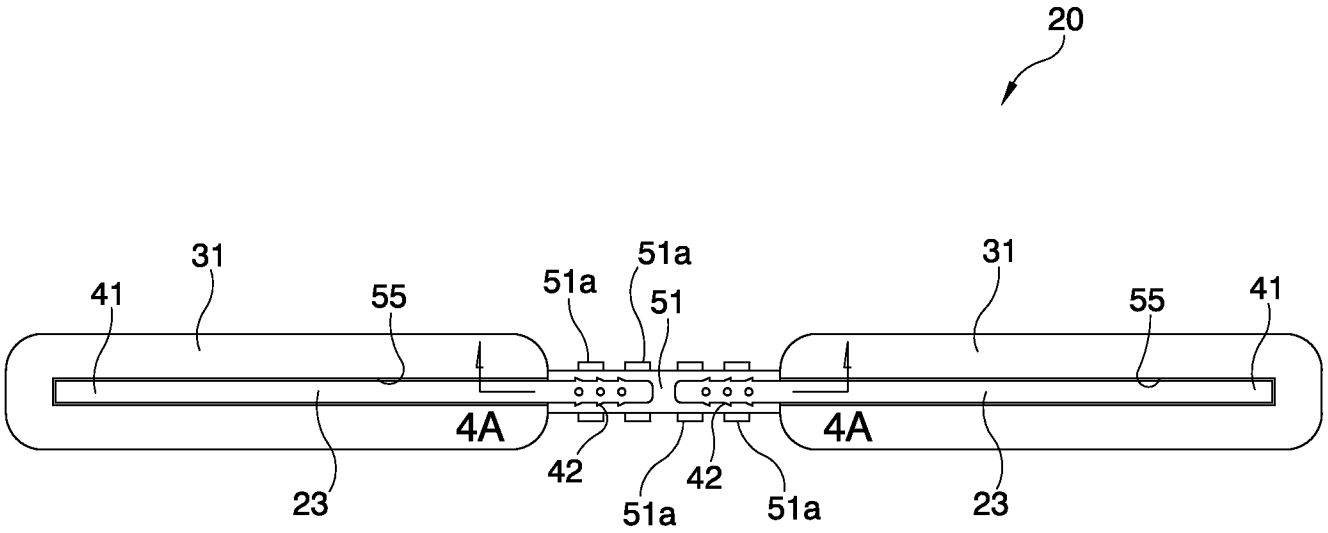
FIG. 4 is a cutaway or cross-sectional view of another embodiment of the present disclosure.
Figure 4A:
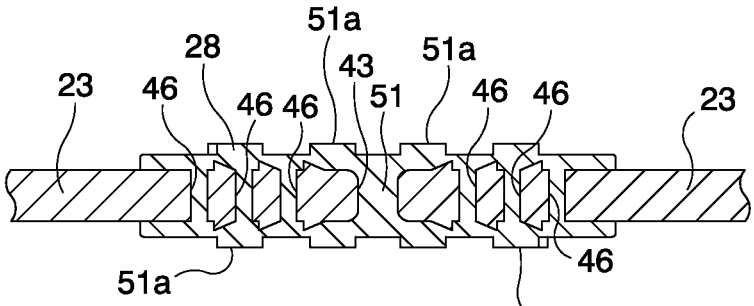
FIG. 4A is a cross-sectional view of the embodiment of FIG. 4, taken along the lines 4A-4A in FIG. 4 and viewed in the direction of the arrows.
Figure 5A:
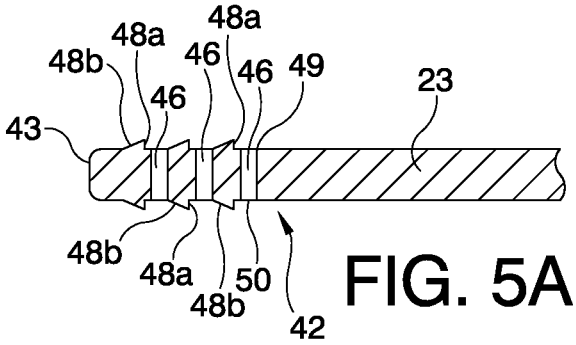
FIG. 5A is a cross-sectional view of the embodiment of FIG. 5, taken along the lines 5A-5A in FIG. 5 and viewed in the direction of the arrows.

Absorbent material or piece 31 covers a substantial portion of rods 23. In the illustrated embodiment, absorbent pieces 31 run from or along distal end 41 of respective rods 23 towards connector 28, extending from a point adjacent to and distal of the proximal-most barb 45 and/or hole 46 to a point beyond the distal-most part of their respective rods 23. Absorbent pieces 31 are shown in the embodiments of FIGS. 3-4 as substantially cylindrical items with a central opening 55, e.g. a sleeve of material that is slid or otherwise fitted onto rod 23. Pieces 31 (or at least an exterior) are of a natural or synthetic material, such as cotton, wool, or other fibrous material, that absorbs or pulls out paint or dye left within the marker. Absorbent pieces or material 31 are attached to their respective rods 23 by a glue or other adhesive or bonding process in particular embodiments. For example, as previously noted, it has been found that wool pieces, with their good absorbency and cleaning properties, is effectively attached by gluing to a fiberglass rod 23. When so attached, pieces 31 are not movable with respect to their respective rods 23. It will be understood that other types of attachment may be used to place pieces 31 on rods 23. Further, rather than a sleeve-type configuration, linear absorbent pieces or materials 31 may be used, as by wrapping around rods 23, helically or circumferentially, or by attachment along the length of rods 23.

Figure 8:
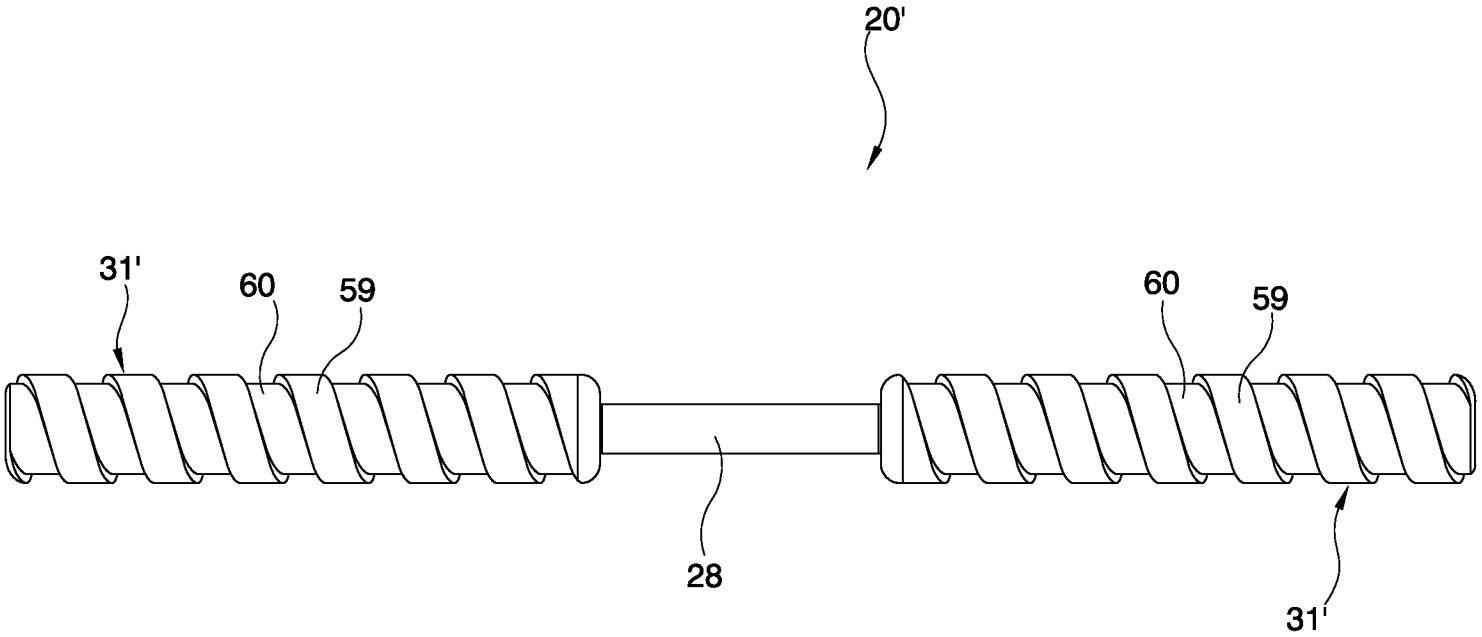
FIG. 8 illustrates an embodiment of a swab with a particular embodiment of tapered, swirled, or twisted material(s) to aid in cleaning.
Figure 9:
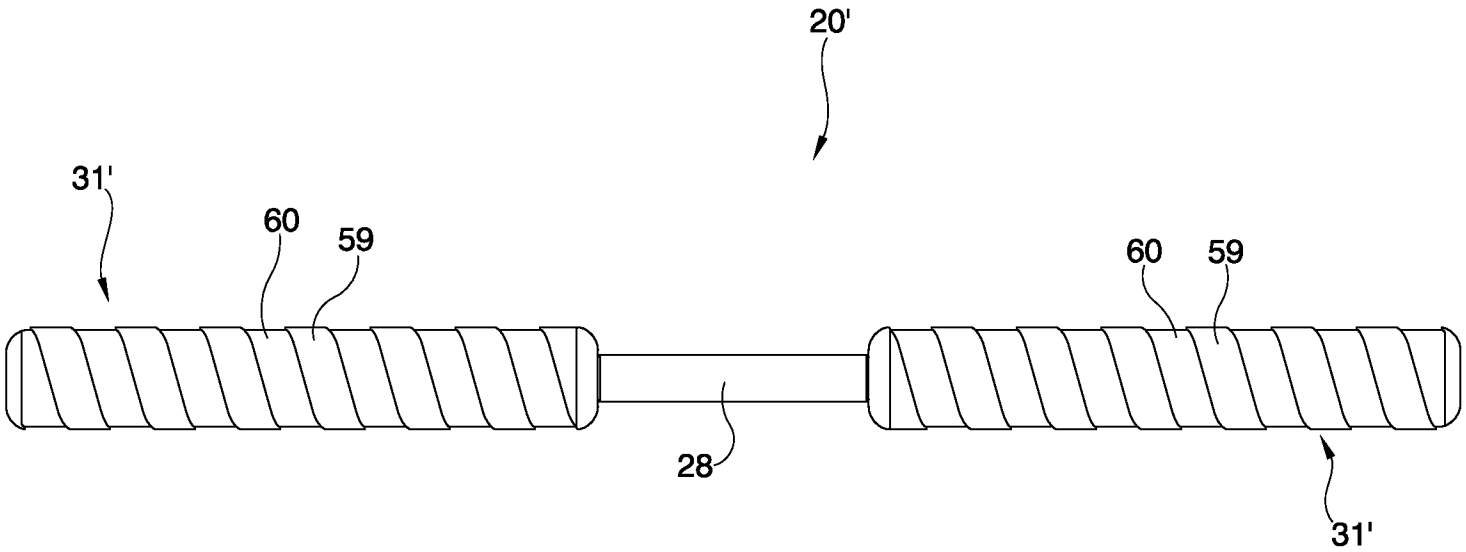
FIG. 9 illustrates an embodiment similar to that in FIG. 8, but with less pronounced tapering, swirling, or twisting.

As seen in the examples of FIG. 8 and FIG. 9, embodiments are contemplated in which material on or attached to the distal portions 41 of one or both of rods 23 alternates in physical or material characteristic(s). For example, FIGS. 8 and 9 show embodiments of a swab 20' having two portions of material 31' that are tapered or otherwise differentiated in surface depth, with a material surface 59 protruding farther from its rod 23 than an adjacent material surface 70. Such tapering of surfaces 59 and 60 may be more pronounced (e.g. FIG. 8, in which surface 59 is about ⅓ to ½ further distant from rod 23 than is surface 60) or less pronounced as in FIG. 9 depending on the cleaning requirements. The configuration examples shown in FIGS. 8 and 9 may be thought of as providing a helical groove (material surface 60) within an outer or further-outwardly extending material surface 59. Surface areas 59 and 60 may be moved closer together so that there are more alterations (e.g. rotations or windings) of surfaces 59 and 60 per unit length of rod 23, or moved farther apart so there are less alterations of surfaces 59 and 60 per unit length of rod 23. In some embodiments, surfaces 59 and 60 are both parts of absorbent materials, such as wool or cotton. In other embodiments, one surface may be part of a microfiber material to provide buff or shine to a contacted surface, and the other may be wool, cotton or other materials. For example, surface 59 may be wool to absorb paint or dye, while surface 60 may be a buffing material. It will be understood that a configuration such as that shown in FIGS. 8 and 9 may be placed on one rod or end of a swab, with the other end having an absorbent material 31 as described above. For example, one end of a swab may include only a buffing material (e.g. 60) and the other end of the swab may include only an absorbent material (e.g. 31).

To manufacture swab 20, two rods 23 are made having the desired characteristics as discussed above. For example, taking the embodiment of rods 23 shown in FIG. 3, rods 23 may be originally molded or otherwise formed with barbs 45 and holes 46. If one or both of barbs 45 or holes 46 are not originally provided, further machining to form barbs 45 or attachment of barbs 45 may be performed, and/or drilling of holes 46 may be done. In particular embodiments, an overmolding process is used to form an outer casing or sleeve that is connector 28. For example, proximal ends or portions 42 of rods 23 are inserted into a mold formed for creation of connector 28, and the material for connector 28 is introduced into the mold. The material fills the mold so as to surround rods 23, with a medial portion 51 of material between rods 23 and with material around and between barbs 45, and to enter holes 46, e.g. extending part or all the way through holes 46. The material is cured so that connector 28 is a flexible solid securely joining rods 23. Thus, once cured, the solid connector 28 is between and engaging barbs 45, and forms columns within or extending all the way through holes 46. In embodiments in which holes 46 extend all the way through rods 23, the connector material may form solid columns through such holes 46 joining diametrically-opposed parts of connector 28. Absorbent pieces 31 are affixed to their respective rods 23 as indicated above.

The use of embodiments of swab 20 will be described with respect to cleaning or clearing the barrel of a paintball marker. It will be understood that cleaning or clearing of other marker parts or paintball equipment will be substantially similar.

When the user determines that his or her paintball marker requires cleaning, he or she retrieves swab 20 and inserts the absorbent material 31 of one end of swab 20 into the barrel. The user can hold swab 20 at the connector 28, or along the absorbent material 31 of the non-inserted end of swab 20. In embodiments of swab 20 having one or more squeegee flanges 52, the user may wish to hold swab 20 along the non-inserted absorbent material 31, so that flange 52 can enter the marker barrel to the desired depth. Flange(s) 52 may push or collect paint or other paintball debris that has been missed by absorbent piece 31 during insertion, so that on manipulation or withdrawal of absorbent piece 31 (see below) that collected material can be absorbed or otherwise picked up by absorbent piece 31.

When swab 20 has been inserted into the barrel as desired, the user can rotate and/or reciprocate swab 20 so as to contact all or as much of the interior of the barrel as is possible. In particular embodiments, the molded connection of connector 28 allows transmission of rotational and translational force from a non-inserted end or rod 23 to an inserted end or rod 23. It is noted that in many cases, practically all of a swab 20 but a distal end will be within a barrel when swab 20 is fully inserted. In such cases, "inserted end or rod" (or similar language) as used herein can refer to a first-inserted end or rod, or a rod inserted distal-end-first. A "non-inserted end or rod" (or similar language) can refer to a second rod or distal end inserted into a barrel proximal end first (e.g. after and along with the first-inserted rod) or one having a distal end extending outside the barrel. Firm contact between connector 28 and barbs 45 and of portion(s) of connector 28 with the surfaces within holes 46 transmit force between rods 23 and connector 28. When the user desires to pull the inserted portion of swab 20 out of the marker, the contact of connector 28 to and through holes 46 and against surfaces (e.g. 48*a* and/or 48*c*) of barbs or protrusions 45 reduces that chance of a rod 23 being pulled out of or away from connector 28. Thus, connector 28 improves the strength of swab 20 and makes separation of rods 23 from each other less likely or more difficult. Pulling the inserted portion of swab 20 out of the marker brings along paint or other paintball debris that is absorbed into, stuck to or otherwise physically moved by absorbent piece 31. In embodiments having one or more squeegee flanges 52, such flange(s) can push or collect any paint or debris out of the marker as it is pulled out of the marker.

As noted above, in particular embodiments connector 28 is a flexible material, and with particular flexible materials swab 20 may be folded so that rods 23 may pivot with respect to each other around proximal ends 42 or around a point between proximal ends 42. Thus, in an extended condition in which swab 20 is used to clean a marker, rods 23 can extend so both make a straight line when connector 28 is straight, and in a folded condition rods 23 may be substantially parallel to and adjacent to each other, for example where distal ends 41 will come in contact with each other and connector 28 is bent. In that folded condition, swab 20 is easily inserted into a user's pocket or pouch (e.g. with bent or folded connector 28 inserted first) so that the user can easily carry swab 20 during paintball games.

Figure 10:
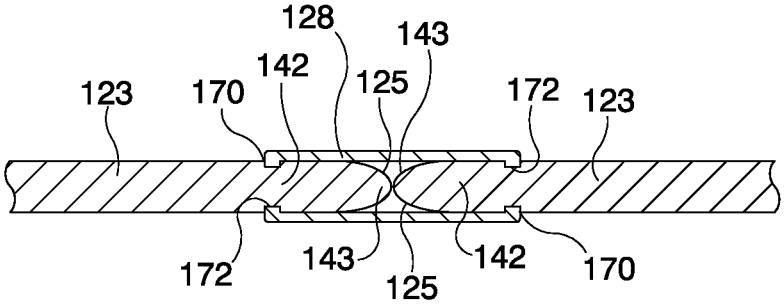
FIG. 10 is a cross-sectional view of an alternative embodiment of a swab according to the present disclosure.

In the embodiments illustrated in FIGS. 3, 4, 6, 7, rods 23 of swab 20 are joined to each other by connector 28 with a distance between them. That volume between rods 23 is filled, partially or fully, by medial portion 51 of connector 28. The embodiment shown in FIG. 10 indicates that rods 123 may be placed in contact with each other at their respective proximal ends 142, with connector 128 molded or otherwise placed or fitted around them. As seen in FIG. 10, embodiments of rods 123 may include one or more grooves 170 instead of or in addition to holes for a sleeve-like connector 128 to snap into, e.g. with protrusions or bosses 172. Embodiments of rods 123 may also or alternatively include a tapered portion 125 in the distal ends 141, as indicated in FIG. 10. While rod 123 has a generally uniform diameter, as indicated above, tapered portion 125 has a diameter that decreases from that generally uniform diameter toward a part-spherical or otherwise rounded end surface 143. In particular embodiments, the taper is substantially constant, so that tapered portion 125 forms a part of the surface of a cone. Such tapered portions 125 are believed to result in the connector sleeve 128 stretching more evenly along the whole connector length, so that there is less stress on the connector sleeve 128 when the device is folded along connector 128, and thus better longevity for connector 128. The rounded end surfaces 143 abut each other in some embodiments, and the space within connector 28 and adjacent those rounded end surfaces 143 is open, e.g. without material of connector 28 occupying it. Thus, in particular embodiments, a space defined by connector 128 and the proximal ends of rods 123 may be void or cleared of material of connector 128.

The embodiment of FIG. 10 does not show barbs, but they can be provided, for instance in the form of embodiments described above. A snap-fit sleeve as connector 128 is less expensive than over-molding, as described above for certain embodiments of connector 128. Insertion of rods 123 into such a sleeve 128 is made easier, in embodiments having barbs 45, by the conical surface 48*b* that tends to spread sleeve 128 as rod 23, 123 is inserted. Naturally, rods 23, 123 without barbs 45 can be inserted into sleeve 28 as well.

An alternative form of a squeegee member 200 that can be attached to a swab rod is shown in a particular embodiment in FIGS. 11A-D. That embodiment shows a rod 123 as generally depicted in FIG. 10. In addition, rod 123 in this embodiment has an end 241 that has a narrower section 241*a* that may be considered a circumferential notch or groove. Comparing FIGS. 11A-D with FIG. 10, end 241 is distal, e.g. opposite to an end of rod 123 connected to connector 128 as seen in FIG. 10. Section 241*a* has a main portion 243 and a forward notch 244 between bosses 246 and 248. Forward circumferential notch 244 is sized and configured to hold a circumferential boss or ring of squeegee member 200, as will be discussed further below. While the illustrated embodiment shows section 241*a* as having a circumferential surface at a smaller radius from the central longitudinal axis of rod 123 than the surface of the rest of rod 123, it will be understood that other embodiments may have one or more longitudinal slots in place of the full-circumferential notch or groove, to accommodate portion(s) of squeegee member 200.

Member 200 is a generally rounded or roughly cylindrical piece having a base 202, a compressible middle portion 204 and a tip portion 206, through each of which a passage or channel 208 extends, in the illustrated embodiment. Channel 208 is sized and configured to allow entry of section 241 a through it, so that at least a portion of member 200 can slide along portion 241*a*, as will be discussed further below. Member 200 is one-piece or monolithic and of a resilient and water- or fluid-resistant material in particular examples, so as to move liquid along a surface with which it is in contact but not necessarily soak up that liquid. Other embodiments may include parts of member 200 that take in liquid such as paint or dye in addition to moving paintball residue.

Figure 11A:
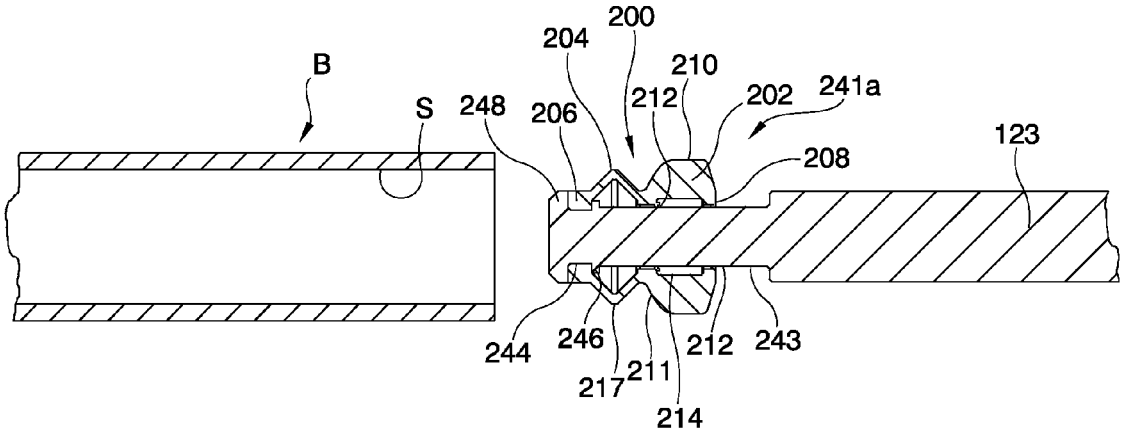
FIG. 11A is a cross-sectional view of an embodiment of a swab having an embodiment of a squeegee member disclosed herein, positioned opposite a device to be cleaned.
Figure 11B:
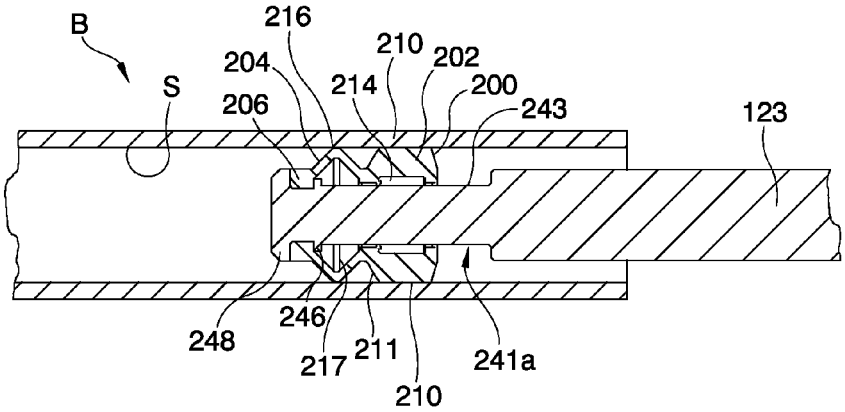
FIG. 11B is a cross-sectional view of the embodiment as in FIG. 11A being inserted into a paintball marker barrel.
Figure 11C:
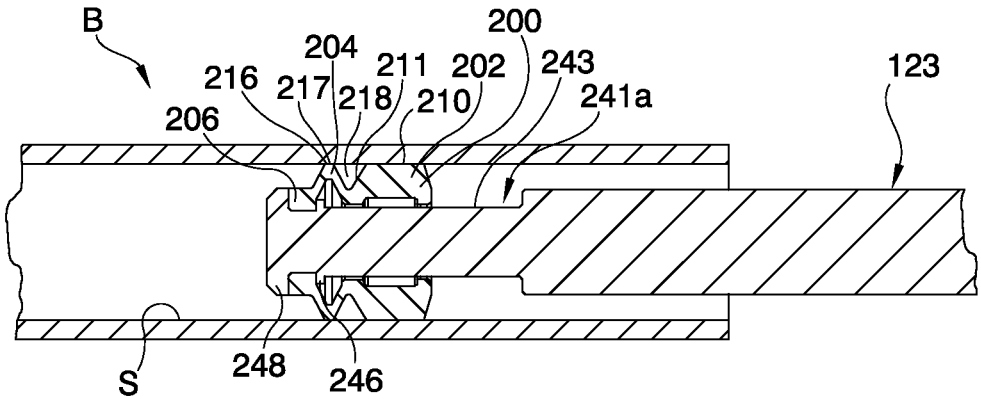
FIGS. 11C-D are a cross-sectional views of embodiments as in FIG. 11A being pulled out of a paintball marker barrel.
Figure 11D:
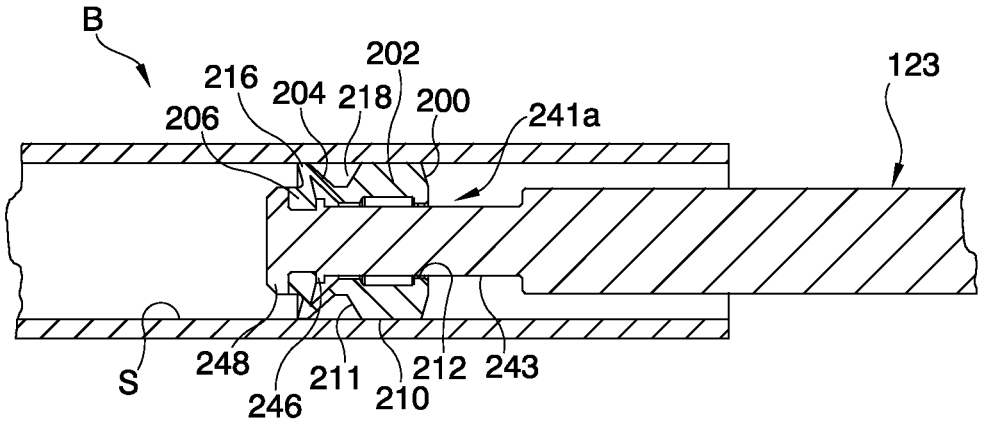
Figure 11E:
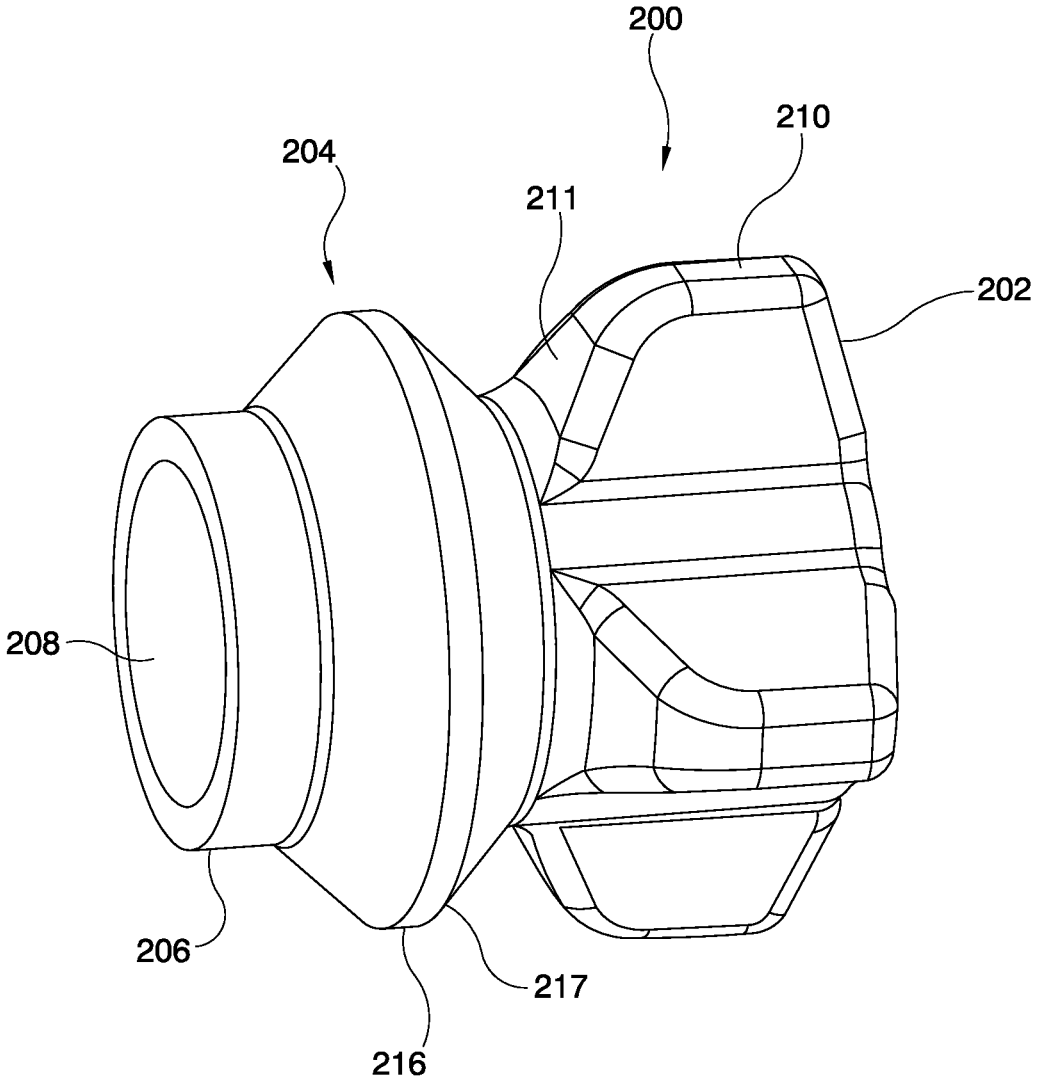
FIG. 11E is a perspective view of the embodiment of a squeegee member as in FIG. 11A.

Base 202 is the widest (i.e. largest radius) portion of member 200 in this embodiment. As shown in FIG. 11E, base 202 may be formed as radial fins (e.g. four such fins as shown) separated by one or more spaces, or in other embodiments may be circumferentially continuous. Each fin of base 202 in this example includes a radially outer surface 210 that curves into a slanted or part conical surface 211 that generally faces toward tip portion 206. Surface 210 is substantially parallel to the central longitudinal axis of rod 123 as illustrated, and may be somewhat pointed inward toward the central longitudinal axis of rod 123 (e.g. with a portion of surface 210 near surface 211 closer to the axis than a portion of surface 210 away from surface 211) in other embodiments. The curve between surfaces 211 and 210 and a sloped surface 210 as indicated above can help in inserting member 200 into a barrel, for example. Base 202 has one or more inner surface portions or supports 212 (e.g. associated with fins of base 202, if present) that face channel 208. The illustrated embodiment shows surface portions 212 that extend around at least a portion of the circumference of channel 208 and are separated longitudinally, to form a chamber or pocket 214 between them. In a rest or non-compressed state, some or all of inner surface portions 212 of base 202 are adjacent or lightly in contact with rod 123 within notch or groove 241*a*. The presence of supports 212 and/or chamber 214 or other discontinuity between surfaces 212, if present, prevents or limits binding or over-compression of base 202 against surface 243, and/or reduces any friction present between base 202 and surface 243, insofar as less of base 202 is in contact with surface 243. However, even absent chamber 214 (i.e. where there is a continuous surface 212), any friction between surface 212 and surface 243 is insufficient to keep base 202 from sliding along surface 243 during use, as is explained further below.

Middle portion 204 is longitudinally compressible between base 202 and tip 206. In the illustrated embodiment, a central circumferential part 216 (which may be or include one or more ribs, beads or other projections 217) forms a crease or fold in an accordion-style when middle portion 204 is compressed longitudinally between base 202 and tip 206. Middle portion 204 forms an angle in the illustrated embodiment with its vertex at portion 216 which ranges from very small (e.g. 10-15 degrees or less, FIGS. 11C-D) when middle portion 204 is compressed, to very large (e.g. 135-160 degrees or more, FIG. 11B) when middle portion 204 is stretched or elongated. In its unstressed or rest form, middle portion 204 may form an angle of about 85-100 degrees (e.g. FIG. 11A). Middle portion 204 is an extendable and retractable flange that wipes along a surface, as will be discussed further.

Tip portion 206 is attached to middle portion 204 and is otherwise substantially in the form of a ring or washer. As seen in the embodiments of FIGS. 11A-D, tip portion 206 is sized and configured so that its ring or boss has a snap-fit within notch 244 of rod 123, between bosses 246 and 248. Accordingly, in such embodiments the diameter of channel 208 within tip portion 206 is smaller than the diameter of channel 208 within base 202. Tip 206 holds squeegee member 200 on rod 123, while allowing base 202 to slide along rod 123 within portion 241*a*.

To assemble squeegee member 200 onto rod 123, the end of rod 123 is inserted through channel 208 of squeegee member 200. For example, the proximal end of rod 123 enters channel 208 at base 202, with squeegee member 200 being resilient so that channel 208 can expand around the end (e.g. boss 248) of rod 123 and contract back to be against or adjacent to the outer surface 243 of rod 123. Likewise, end 248 of rod 123 is pushed through the rest of channel 208 so that it is beyond the end of tip portion 206. Tip 206 snaps into notch 244 between bosses 246 and 248 in the illustrated embodiment. Thus, tip 206 remains stationary or locked with respect to rod 123, while base portion 202 can slide along surface 243 within portion 241*a*. As base 202 moves away from tip 206, middle portion 204 extends, increasing its internal angle and bringing central part 216 radially inward or toward rod 123. As base 202 moves toward tip 206, middle portion 204 is compressed, decreasing its internal angle and moving central part 216 radially outward or away from rod 123.

Use of squeegee member 200 assembled to rod 123 will now be described with respect to cleaning the barrel of a paintball marker. It will be understood that use of squeegee member 200 in other forms, to clean other items, or for other tasks is contemplated.

The user grips a portion of rod 123 directly or indirectly and guides its proximal end 248 and squeegee member 200 to the opening of a paintball marker barrel B. In the illustrated embodiment, squeegee member 200 in an unstressed condition (FIG. 11A) has a base portion 202 that is sized to fit snugly or drag against the inner surface S of barrel B, and a middle portion 204 that does not contact that inner surface of barrel B. As rod 123 is inserted into barrel B, surface(s) 211 of base 202 (and surface(s) 210 if sloping inward toward end 248, as described above) help guide base 202 into barrel B, and surface S engages surface 210 of base 202. Friction between surfaces S and 210 holds base 202 or prevents it from moving forward as much as rod 123 does. That is, the distance between base 202 and tip 206 increases as rod 123 is pushed forward and member 200 is initially inserted, due to the friction between surfaces S and 210. As that distance increases, middle portion 214 is extended, moving central part 216 toward rod 123 and away from barrel surface S. When middle portion 214 is extended (e.g. FIG. 11B), further pushing of rod 123 drags base 202 further into barrel B. During insertion of squeegee member 200 into barrel B, consequently, central part 216 is kept away from surface S and does not force any paint or debris further into barrel B. Surfaces 210 and/or 211 may push paint or debris along, but such paint or debris is not pushed further than central part 216. In embodiments having multiple fins separated by space(s), paint or debris to be cleaned out of barrel B may pass through space(s) between the fins, remaining undisturbed during insertion of member 200.

Once squeegee member 200 and rod 123 are inserted fully or to the desired degree, and rod 123 is manipulated to any degree that may be desired, rod 123 and squeegee member are pulled out from barrel B. When pulling force is applied to rod 123, the friction between barrel surface S and surface 210 of base 202 tends to maintain base 202 in place while tip portion 206 (fixed to rod 123) is pulled toward base 202. When the distance between tip 206 and base 202 decreases, middle portion 204 is compressed, which moves central part 216 outward from rod 123 and into contact with barrel surface S (FIG. 11C). As rod 123 is pulled out, central part 216 is pressed against and dragged along surface S, so that paint, debris or other undesirable matter is pushed along between central part 216 and base 202. As indicated in the drawings, a volume or pocket 218 may be created between central part 216 and base 202 in such embodiments which tends to hold or contain material to be cleared out of barrel B. In some embodiments, central part 216 is forced against surface S so that sufficient friction is generated to pull central part 216 toward tip 206 during extraction. For example, the embodiment of FIG. 11D shows central part 216 moved toward tip 206 to such an extent that an angle between a forward part of middle portion 204 forms an acute angle with respect to tip 206, as opposed to the obtuse angles between them seen in FIGS. 11A-C.

When squeegee member 200 is fully removed from barrel B, it can then be cleaned of the paint, debris or other matter on it that was removed from barrel B, as by wiping, rinsing or manually flicking or throwing off such matter. In embodiments in which squeegee member 200 is resilient, removal from barrel B permits base 202 to move along notch or groove 241*a* to an original or unstressed state (e.g. FIG. 11A). If desired, in particular embodiments squeegee member 200 may be removed from rod 123 for cleaning and reassembled with rod 123 for further use.

As noted above, this embodiment of squeegee member 200 is shown on the distal end of a rod 123, which may be attached via a connector 128 to another rod 123 as indicated in one example in FIG. 10. It will be understood that squeegee member 200 may be attached to one end of a single rod 23, 123 (i.e. one unattached to a connector 28, 128 or a second rod), the other end of which has a cleaning part (e.g. one or more of items 31, 31' described above). Of course, one or both rods 23 of a swab 20 or 20', for instance, may have (instead of a piece 31, 31') a configuration as seen in FIGS. 11A-D and an embodiment of squeegee member 200. It is also contemplated that embodiments of squeegee member 200 can be used in place of flange 52 and/or as part of a connector such as connector 28. For example, squeegee member 200 could be attached to one rod (e.g. rod 23) with an area 241*a* placed between protrusions 45 and holes 46 and the proximal tip of rod 23. As another example, rather than having notches 241*a* and 244 on one rod, notch 244 may be on one rod, which attaches to tip 206 of member 200, and notch 241 a may be on the other, allowing base 202 to slide along that other rod. Such embodiments may have rods (e.g. rods 23 and/or 123) in abutment or in a close connection, and/or have a sleeve 28 outside squeegee member 200 as the cleaning surface (e.g. a surface pressed against a barrel interior).

"Absorbent" as used herein with regard to items 31 is intended to refers not only to an ability to take in a substance (e.g. paint or dye inside a marker) within the material or spaces within the material, like a sponge or cloth, but also to the ability to attract or hold a substance to the surface (e.g. to surface roughness) of the material. Examples of absorbent material that take in a substance are wool and cotton (woven or otherwise), and may be washable.

While the subject matter herein has been illustrated and described in detail in the exemplary drawings and foregoing description, the same is to be considered as illustrative and not restrictive in character, it being understood that only the preferred embodiment(s) have been shown and described and that all changes and modifications that come within the spirit of the disclosure are desired to be protected. It will be understood that structures, methods or other features described particularly with one embodiment can be similarly used or incorporated in or with respect to other embodiments.

What is claimed is:

1. A cylindrical cleaning device for paintball equipment, comprising:

at least two rods, each rod having a proximal end with at least one barb and with at least one through hole;

a connector that engages said at least one barb of each rod and enters said at least one through hole of each rod; and at least one cleaning piece, located on at least one of said rods or on said connector.

2. The device of claim 1, further comprising at least one squeegee flange operatively connected to one or both of the rods and the connector.

3. The device of claim 1, further comprising a respective absorbent material surrounding a distal end of each respective rod, with the absorbent material placed in a tapered or alternating pattern.

4. The device of claim 1, further comprising a squeegee member fitted to at least one of said rods, said squeegee member having a base, a middle portion having a fold, and a tip portion, said tip portion held stationary with respect to said at least one of said rods and said base being slidable with respect to said tip portion and said at least one of said rods, wherein when said base slides toward said tip portion, said middle portion is compressed so that said fold moves away from said at least one of said rods, and wherein when said base slides away from said tip portion, said middle portion is extended so that said fold moves toward said at least one of said rods.

5. A device for cleaning paintball equipment, comprising:

a first rod having a distal portion and a proximal portion, said proximal portion of said first rod having at least one feature from the group consisting of barbs and openings directed outward from a central longitudinal axis of said first rod;

a second rod having a distal portion and a proximal portion, said proximal portion of said second rod having at least one feature from the group consisting of barbs and openings directed outward from a central longitudinal axis of said second rod;

a connector attached to each of said proximal portions, said connector in contact with each of said features, wherein if a feature is a barb, said contact comprises contacting at least a portion of the barb, and if a feature is an opening, said contact comprises a portion of said connector entering the opening; and a first absorbent piece fixed to said distal portion of said first rod, and a second absorbent piece fixed to said distal portion of said second rod.

6. The device of claim 5, wherein said connector is a natural or synthetic rubber material.

7. The device of claim 5, wherein said connector is flexible, so that in a first unfolded condition said connector holds said rods so that said rods are at least approximately linear with each other, and in a second folded condition said connector bends and holds said rods so that said rods are at least approximately parallel to and laterally adjacent to each other.

8. The device of claim 5, wherein said at least one opening of said first rod and said at least one opening of said second rod are each linear through holes, each having respective first and second apertures diametrically opposed on each said rod.

9. The device of claim 8, wherein said connector extends through both said first and second apertures of each said through hole.

10. The device of claim 9, wherein said connector forms a monolithic column within each said through hole.

11. The device of claim 5, wherein said at least one opening of said first rod and said at least one opening of said second rod are each grooves, and said connector includes a boss entering said groove to hold said rods and said connector together.

12. The device of claim 5, wherein said connector has a solid medial portion adjacent to said rods, and further comprising at least one squeegee flange at said medial portion of said connector.

13. The device of claim 12, wherein said squeegee flange is of the same material as said connector and is monolithic with said connector.

14. The device of claim 5, wherein at least one of said proximal portions of said rods has a tapering surface that extends to a rounded proximal end.

15. The device of claim 5, wherein at least two barbs and two holes are provided for each said rod.

16. A paintball equipment cleaning device, comprising:

a first rod with a central longitudinal axis, said first rod having a first proximal portion and a first distal portion, said first proximal portion including a first plurality of barbs and a first plurality of holes, each of said first plurality of barbs having a proximally-facing surface that is substantially perpendicular to said central longitudinal axis of said first rod and a generally distally-facing surface that is angled with respect to said central longitudinal axis of said first rod, and each of said first plurality of holes being linear and extending through a full diameter of said first rod;

a second rod with a central longitudinal axis, said second rod having a second proximal portion and a second distal portion, said second proximal portion including a second plurality of barbs and a second plurality of holes, each of said second plurality of barbs having a proximally-facing surface that is substantially perpendicular to said central longitudinal axis of said second rod and a generally distally-facing surface that is angled with respect to said central longitudinal axis of said second rod, and each of said second plurality of holes being linear and extending through a full diameter of said second rod;

a flexible connector attached to said first proximal portion and said second proximal portion to connect said first and second rods together, said connector contacting at least said proximally-facing surfaces of each of said first and second pluralities of barbs, said connector having respective portions extending through each of said first and second pluralities of holes, said connector further having a medial portion with at least one full-circumferential flange; and, at least one cleaning piece fixed to one of said distal portions of said first rod or said second rod or said connector.

17. The device of claim 16, further comprising a first absorbent piece attached to said distal portion of said first rod.

18. The device of claim 17, further comprising a second absorbent piece attached to said distal portion of said second rod.

19. The device of claim 16, wherein said connector is a monolithic piece of a single material.

20. The device of claim 16, wherein said respective portions of said connector are columns that extend entirely through said holes and join connector portions on diametrically-opposed portions of said rods.

21. The device of claim 16, wherein at least one of said first and second rods have a tapered portion of their respective proximal portions.

22. A cylindrical cleaning device for paintball equipment, comprising:

at least one rod having a distal end, said distal end having a circumferential notch; and a squeegee member fitted to said at least one rods, said squeegee member having a base, a middle portion having a fold, and a tip portion, said tip portion held stationary with respect to said at least one rod and said base being slidable with respect to said tip portion and said at least one rod within said notch, wherein when said base slides toward said tip portion, said middle portion is compressed so that said fold moves away from said at least one rod, and wherein when said base slides away from said tip portion, said middle portion is extended so that said fold moves toward said at least one rod.

23. The device of claim 22, wherein said base includes a plurality of radial fins configured to engage an inner diameter of a structure to be cleaned, said fins separated by at least one space, whereby material to be cleaned by said device can pass by said fins through said at least one space.

24. The device of claim 22, wherein said base is configured to engage an inner diameter of a structure to be cleaned, and during insertion of said squeegee member into the structure to be cleaned, said base is at least partially held by the inner diameter of the structure to move said base away from said tip portion to create a space between said fold and the inner diameter of the structure.

25. The device of claim 22, wherein said base is configured to engage an inner diameter of a structure to be cleaned, and during pulling out of said squeegee member from the structure to be cleaned, said base is at least partially held by the inner diameter of the structure to move said base toward said tip portion to force said fold against the inner diameter of the structure.

26. The device of claim 22, wherein said base has at least one support adjacent a surface of said rod, said support preventing said the entirety of said base from compressing against said rod surface during use.

27. The device of claim 22, wherein said squeegee member is adapted for insertion into and withdrawal from a structure having an internal surface to be cleaned, and wherein during insertion said fold is extended so as not to contact the internal surface and during withdrawal said fold is compressed so as to be pressed against the internal surface, and wherein changes to or from said extended state or said compressed state automatically occurs by changing insertion or withdrawal characteristics.

28. A device for cleaning paintball equipment, comprising:

a first rod having a distal portion and a proximal portion, said proximal portion of said first rod having at least one feature from the group consisting of barbs and openings directed outward from a central longitudinal axis of said first rod;

a second rod having a distal portion and a proximal portion, said proximal portion of said second rod having at least one feature from the group consisting of barbs and openings directed outward from a central longitudinal axis of said second rod;

a connector attached to each of said proximal portions, said connector in contact with each of said features, wherein if a feature is a barb, said contact comprises contacting at least a portion of the barb, and if a feature is an opening, said contact comprises a portion of said connector entering the opening; and a first absorbent piece fixed to said distal portion of said first rod, and a second absorbent piece fixed to said distal portion of said second rod, wherein said at least one opening of said first rod and said at least one opening of said second rod are each linear through holes, each having respective first and second apertures diametrically opposed on each said rod.

29. The device of claim 28, wherein said connector extends through both said first and second apertures of each said through hole.

30. The device of claim 29, wherein said connector forms a monolithic column within each said through hole.

31. A device for cleaning paintball equipment, comprising:

a first rod having a distal portion and a proximal portion, said proximal portion of said first rod having at least one feature from the group consisting of barbs and openings directed outward from a central longitudinal axis of said first rod;

a second rod having a distal portion and a proximal portion, said proximal portion of said second rod having at least one feature from the group consisting of barbs and openings directed outward from a central longitudinal axis of said second rod;

a connector attached to each of said proximal portions, said connector in contact with each of said features, wherein if a feature is a barb, said contact comprises contacting at least a portion of the barb, and if a feature is an opening, said contact comprises a portion of said connector entering the opening; and a first absorbent piece fixed to said distal portion of said first rod, and a second absorbent piece fixed to said distal portion of said second rod, wherein said connector has a solid medial portion adjacent to said rods, and further comprising at least one squeegee flange at said medial portion of said connector.

32. The device of claim 31, wherein said squeegee flange is of the same material as said connector and is monolithic with said connector.

* * * * *